US011514878B2

(12) United States Patent
Semperlotti et al.

(10) Patent No.: US 11,514,878 B2
(45) Date of Patent: Nov. 29, 2022

(54) HELMHOLTZ RESONATORS WITH BROADBAND CAPABILITY

(71) Applicant: Purdue Research Foundation, West Lafayette, IN (US)

(72) Inventors: Fabio Semperlotti, Lafayette, IN (US); Mehdi Jokar, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 841 days.

(21) Appl. No.: 16/285,182

(22) Filed: Feb. 25, 2019

(65) Prior Publication Data

US 2019/0266990 A1 Aug. 29, 2019

Related U.S. Application Data

(60) Provisional application No. 62/634,424, filed on Feb. 23, 2018.

(51) Int. Cl.
*G10K 11/16* (2006.01)
*G10K 11/172* (2006.01)

(52) U.S. Cl.
CPC ..... *G10K 11/161* (2013.01); *G10K 11/172* (2013.01); *G10K 2210/1281* (2013.01);
(Continued)

(58) Field of Classification Search
CPC ..... G10K 11/161; G10K 11/172; G10K 2210/1281; G10K 2210/3214; G10K 2210/32272; G10K 2210/512
See application file for complete search history.

(56) References Cited

U.S. PATENT DOCUMENTS 10,674,253 B2 * 6/2020 Lesso ..... H04R 29/004
2019/0058941 A1 * 2/2019 Martincic ..... G10K 11/16
2019/0321230 A1 * 10/2019 Van 'T Hof ..... A61F 11/08

FOREIGN PATENT DOCUMENTS

CN 110392323 A * 10/2019 ..... G10K 11/26
DE 102018133395 A1 * 6/2020

OTHER PUBLICATIONS

Sugimoto, N., Propagation of nonlinear acoustic waves in a tunnel with an array of Helmholtz resonators. Journal of Fluid Mechanics, 244, 55-78, 1992.

(Continued)

*Primary Examiner* — David L Ton
(74) *Attorney, Agent, or Firm* — Purdue Research Foundation

(57) ABSTRACT

A method of using an acoustic resonator including receiving at a first stage of a resonator an incoming acoustic wave. The method further includes resonating the incoming wave with a flexible membrane, a taper of the flexible membrane, and a cavity of a first stage, thereby producing synergistic effect on a resulting acoustic resonance. Additionally, the method includes transforming an acoustic energy associated with the incoming acoustic wave into an elastic energy, wherein the elastic energy is channeled through the flexible membrane, thereby reducing an intensity of the incoming acoustic wave and resulting in a first reduced incoming acoustic wave. Further the method includes transferring the first reduced incoming acoustic wave through a hole of a neck of the flexible membrane. The method also includes transferring a first pressure wave caused by a perturbation in the flexible membrane into a second stage, thereby producing a second acoustic wave.

16 Claims, 7 Drawing Sheets

(52) U.S. Cl.
CPC ..... *G10K 2210/3214* (2013.01); *G10K 2210/32272* (2013.01); *G10K 2210/512* (2013.01)

(56) References Cited

OTHER PUBLICATIONS

Sugimoto, N. et al., Dispersion characteristics of sound waves in a tunnel with an array of Helmholtz resonators. The Journal of the Acoustical Society of America, 97(3), 1446-1459, Mar. 1995.
Sugimoto, N., Acoustic solitary waves in a tunnel with an array of Helmholtz resonators. The Journal of the Acoustical Society of America, 99(4), Pt. 1,1971-1976, Apr. 1996.
Kim, S, et al., A theoretical model to predict the low-frequency sound absorption of a Helmholtz resonator array (L). The Journal of the Acoustical Society of America, 119(4),1933-1936, Apr. 2006.
Wang, X. et al., Disorder in a periodic Helmholtz resonators array. Applied Acoustics, 82, 1-5, 2014.
Wang, X. et al., Wave propagation in a duct with a periodic Helmholtz resonators array. The Journal of the Acoustical Society of America, 131(2), 1172-1182, Feb. 2012.
Fang, N. et al., Ultrasonic metamaterials with negative modulus. Nature Materials, vol. 5 (6), 452-456, Jun. 2006.
Monkewitz, P. A., The response of Helmholtz resonators to external excitation. Part 2. arrays of slit resonators. Journal of Fluid Mechanics, 156, 151-166, 1985.
Wang, X. et al., Acoustic performance of a duct loaded with identical resonators. The Journal of the Acoustical Society of America, 131(4), EL316-EL322, Apr. 2012.
De Bedout, J. M. et al., Adaptive-passive noise control with self-tuning Helmholtz resonators. Journal of Sound and Vibration, 202(1), 109-123, 1997.
Mironov, M. A., Propagation of a flexural wave in a plate whose thickness decreases smoothly to zero in a finite interval, N.N. Andreev Acoustics Institute, Academy of Sciences of the USSR, 1988.
Krylov, V. V. et al., Experimental investigation of the acoustic black hole effect for flexural waves in tapered plates. Journal of Sound and Vibration, 300, 43-49, 2007.
O'Boy, D. J. et al., Damping of flexural vibrations in rectangular plates using the acoustic black hole effect. Journal of Sound and Vibration, 329(22), 4672-4688, 2010.
Georgiev, V. B. et al., Damping of structural vibrations in beams and elliptical plates using the acoustic black hole effect. Journal of Sound and Vibration, 330(11), 2497-2508, 2011.
Zhu, H. et al., Phononic thin plates with embedded acoustic black holes. Physical Review B 91, 104304, 1-9, 2015.
Krylov, V. V. et al., Acoustic 'black holes' for flexural waves as effective vibration dampers. Journal of Sound and Vibration, 274, 605-619, 2004.
Krylov, V. V., New type of vibration dampers utilising the effect of acoustic'black holes'. Acta Acustica united with Acustica, 90(5), 830-837, 2004.
Bowyer, E. P. et al., Damping of flexural vibrations in turbofan blades using the acoustic black hole effect. Applied Acoustics, 76, 359-365, 2014.
Aklouche, O. et al., Model of flexural wave scattering from an acoustic black hole in an infinite thin plate. In XIX th Symposium Vibrations Shocks and Noise, Aix En Provence, France, Jun. 2014.
Conlon, S. C. et al., Numerical analysis of the vibroacoustic properties of plates with embedded grids of acoustic black holes. The Journal of the Acoustical Society of America, 137(1), 447-457, Jan. 2015.
Gusev, V. E. et al., Propagation of flexural waves in inhomogeneous plates exhibiting hysteretic nonlinearity: Nonlinear acoustic black holes. Ultrasonics, 61, 26-135, 2015.
Denis, V. et al., Modal Overlap Factor of a beam with an acoustic black hole termination. Journal of Sound and Vibration, 333(12), 2475-2488, 2014.
Zhao, L. et al., Broadband energy harvesting using acoustic black hole structural tailoring. Smart Materials and Structures, 23(6), 065021, 9 pgs., 2014.
Zhao, L. et al., An experimental study of vibration based energy harvesting in dynamically tailored structures with embedded acoustic black holes. Smart Materials and Structures, 24(6), 065039, 9 pgs., 2015.
Steele, C.R. et al., Comparison of WKB calculations and experimental results for three-dimensional cochlear models. The Journal of the Acoustical Society of America, 65(4), 1007-1018, Apr. 1979.
Foucaud, S. et al., Artificial cochlea and acoustic black hole travelling waves observation: Model and experimental results. Journal of Sound and Vibration, 333(15), 3428-3439, 2014.
Yang, M. Y., Development of master design curves for particle impact dampers. PhD thesis, 2003, The Pennsylvania State University, The Graduate School Department of Mechanical and Nuclear Engineering, UMI No. 3119079, ProQuest Information and Learning Company.
De Bedout, J. M. et al., L. Adaptive-passive noise control with self-tuning Helmholtz resonators. Journal of Sound and Vibration, 202(1), 109-123, 1997.
Griffin, S. et al., Coupled Helmholtz Resonators for Acoustic Attenuation. Journal of Vibration and Acoustics 123, 11-17, Jan. 2001.
Tang, P. K. et al., Theory of a generalized Helmholtz resonator. Journal of Sound and Vibration, 26(2), 247-262 (1973).
Zhou, X. et al., The energy absorption properties of Helmholtz resonators enhanced by acoustic black holes, 45th International Congress and Exposition on Noise Control Engineering: Towards a Quieter Future, Inter-Noise 2016, Aug. 21-Aug. 24, 2016, German Acoustical Society (DEGA), Hamburg, Germany, 2016.
Zhao, L. et al., Broadband energy harvesting using acoustic black hole structural tailoring. Smart Mater. Struct. 23, 065021, 9 pgs., 2014.
Zhao, L. et al., Embedded Acoustic Black Holes for semi-passive broadband vibration attenuation in thin-walled structures J. Sound Vibrat 388, 42-52, 2016.
Zhu, H. et al., Phononic thin plates with embedded acoustic black holes. Physical Review B (Condensed Matter and Materials Physics), American Physical Society, 91, 104304, 9 pgs., 2015.
Hatfield, J. et al., Noise problems associated with US Army Aircarft, United States Army Aeromedical Research Unit, Fort Rucker, AL, USAARU Report No. 63-1, Jun. 1963.

* cited by examiner

HELMHOLTZ RESONATORS WITH BROADBAND CAPABILITY

CROSS-REFERENCE TO RELATED APPLICATIONS

The present U.S. Patent Application is related to and claims the priority benefit of U.S. Provisional Patent Application Ser. No. 62/634,424, filed Feb. 23, 2018, the contents of which is hereby incorporated by reference in its entirety into this disclosure.

TECHNICAL FIELD

This disclosure relates to Helmholtz resonators (HR) that are able to provide broadband control of acoustic pressure levels waves for applications related to noise, vibration, and flow control.

BACKGROUND

This section introduces aspects that may help facilitate a better understanding of the disclosure. Accordingly, these statements are to be read in this light and are not to be understood as admissions about what is or is not prior art.

Helmholtz resonators (HR) are applied extensively in engineering acoustics as devices for passive control of noise and noise-induced vibrations. A traditional Helmholtz resonator is an object made of a rigid container (with either one or two openings) in which a fluid (typically air) can resonate at a prescribed frequency. The HR is connected to a primary structure (e.g. a duct) in which a fluctuating pressure field is to be controlled. The resonance in the HR cavity (the so-called Helmholtz resonance) can attenuate a specific harmonic of the main pressure field so as to reduce the overall amplitude of the pressure oscillations in the main duct. The effect on acoustic pressure waves is similar to a vibration absorber on structural systems. The main limitation of existing HR systems is in their narrowband operating conditions, that is they provide optimal damping only at a single frequency. This characteristic has a tendency to limit the maximum utility to steady-state conditions.

FIGS. 1A through 1E illustrate examples of traditional Helmholtz Resonators in real world applications. FIG. 1A illustrates brass spherical HR as conceived by Von Helmholtz (1859). FIG. 1B is a conceptual schematic illustrating the parallel between the operating principle of a mechanical vibration absorber and a HR. Referring to FIG. 1B, the "vibration absorber corresponds to the resonating air inside the cavity, i.e. the HR, while the flow in the duct represents the "primary system". FIGS. 1C though 1E represent an overview of different real-world applications of the traditional HR, and indicate controlling muffler sound level, interior noise of a concert hall and wall lining of a space launchers fairing respectively.

Thus there exists a need for Helmholtz Resonators capable of operating in a broader range of frequencies.

SUMMARY

One aspect of the present application relates to a method of using an acoustic resonator including receiving at a first stage of a resonator an incoming acoustic wave. The method further includes resonating the incoming wave with a flexible membrane, a taper of the flexible membrane, and a cavity of a first stage, thereby producing synergistic effect on a resulting acoustic resonance. Additionally, the method includes transforming an acoustic energy associated with the incoming acoustic wave into an elastic energy, wherein the elastic energy is channeled through the flexible membrane, thereby reducing an intensity of the incoming acoustic wave and resulting in a first reduced incoming acoustic wave. Further the method includes transferring the first reduced incoming acoustic wave through a hole of a neck of the flexible membrane. The method also includes transferring a first pressure wave caused by a perturbation in the flexible membrane into a second stage, thereby producing a second acoustic wave.

Another aspect of the present application relates to a method of using an acoustic resonator including receiving at a first stage of a resonator an incoming acoustic wave. The method further includes resonating the incoming wave with a flexible membrane, a taper of the flexible membrane, and a cavity of a first stage, thereby producing synergistic effect on a resulting acoustic resonance. Additionally, the method includes transforming an acoustic energy associated with the incoming acoustic wave into an elastic energy, wherein the elastic energy is channeled through the flexible membrane, thereby reducing an intensity of the incoming acoustic wave and resulting in a first reduced incoming acoustic wave. Further the method includes transferring the first reduced incoming acoustic wave through a hole of a neck of the flexible membrane. The method also includes transferring a first pressure wave caused by a perturbation in the flexible membrane into a second stage, thereby producing a second acoustic wave. The method further includes receiving at a first stage of a second acoustic resonator, through a connection, the first reduced incoming acoustic wave and the second acoustic wave, wherein the connection is in fluid communication with the second stage of the acoustic resonator and the first stage of the second acoustic resonator.

Still another aspect of the present application relates to a method of using an acoustic resonator including receiving at a first stage of a resonator an incoming acoustic wave. The method further includes resonating the incoming wave with a cavity of a first stage, thereby producing synergistic effect on a resulting acoustic resonance. Additionally, the method includes transforming an acoustic energy associated with the incoming acoustic wave into an elastic energy, thereby reducing an intensity of the incoming acoustic wave and resulting in a first reduced incoming acoustic wave. Furthermore, the method includes transferring the first reduced incoming acoustic wave through a connection, wherein the connection is in fluid communication with the first stage of the acoustic resonator and a second stage of a second acoustic resonator.

BRIEF DESCRIPTION OF DRAWINGS

One or more embodiments are illustrated by way of example, and not by limitation, in the figures of the accompanying drawings, wherein elements having the same reference numeral designations represent like elements throughout. It is emphasized that, in accordance with standard practice in the industry, various features may not be drawn to scale and are used for illustration purposes only. In fact, the dimensions of the various features in the drawings may be arbitrarily increased or reduced for clarity of discussion.

DETAILED DESCRIPTION

Figure 1B:
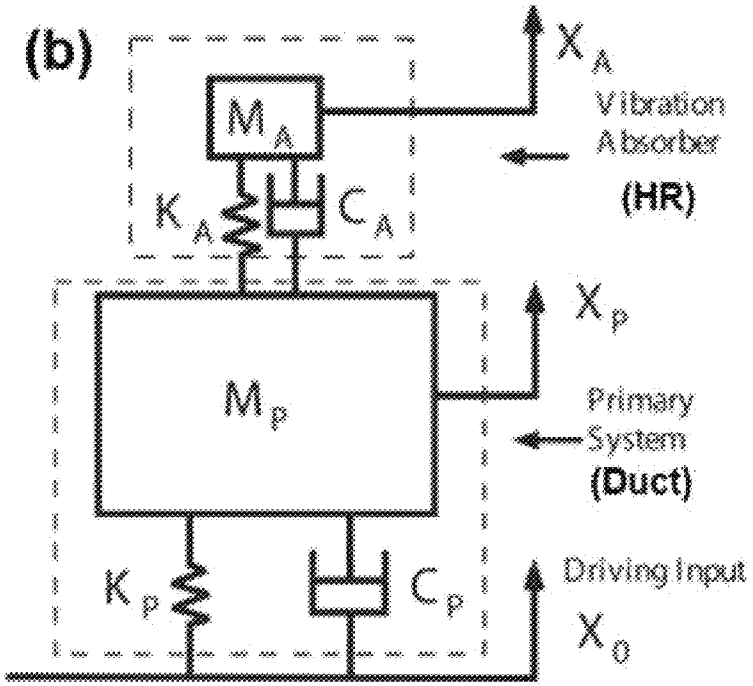
FIG. 1B is a conceptual schematic illustrating the parallel between the operating principle of a mechanical vibration absorber and a HR.
Figure 1A:
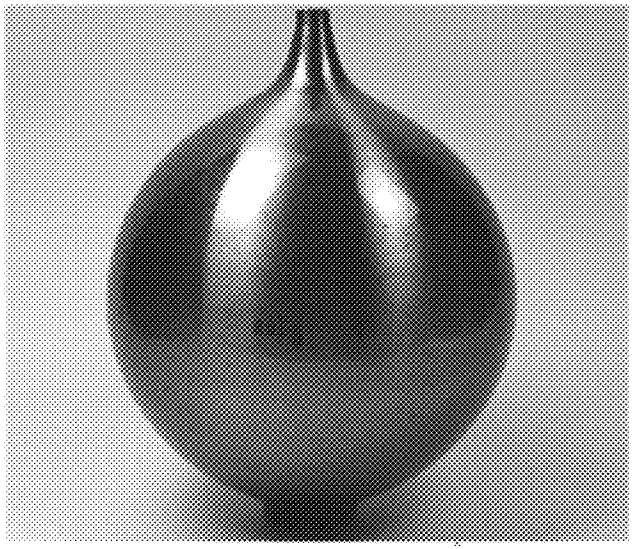
FIG. 1A shows brass spherical HR as conceived by Von Helmholtz (1859).
Figure 1D:
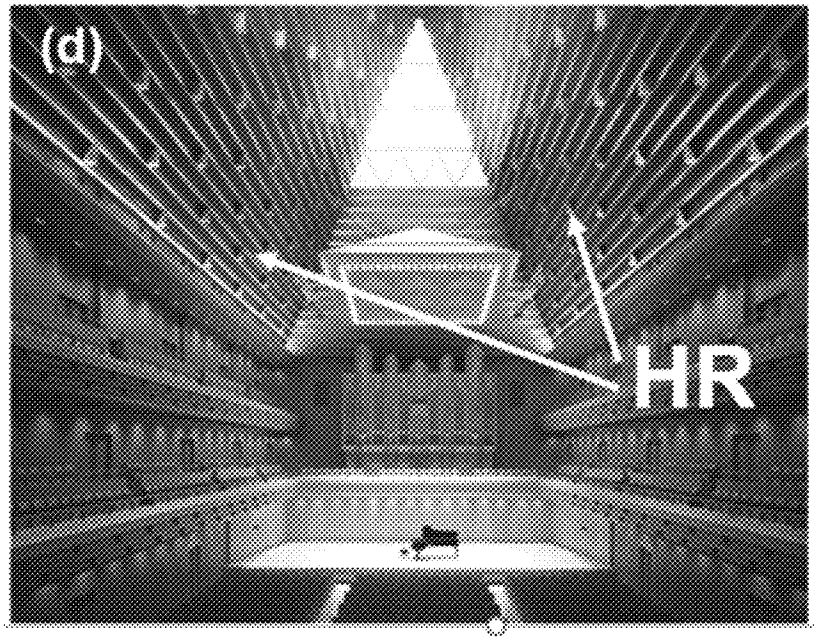
FIG. 1D illustrates a real-world application of a traditional HR with interior noise of a concert hall.
Figure 1C:
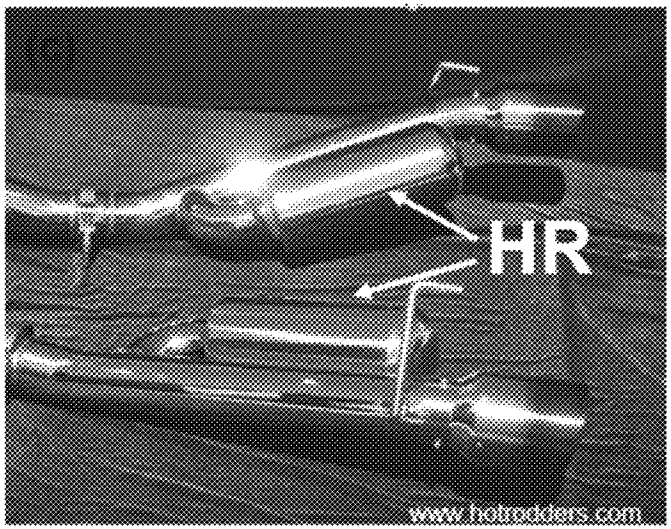
FIG. 1C illustrates a real-world application of a traditional HR with controlling muffler sound level.
Figure 1E:
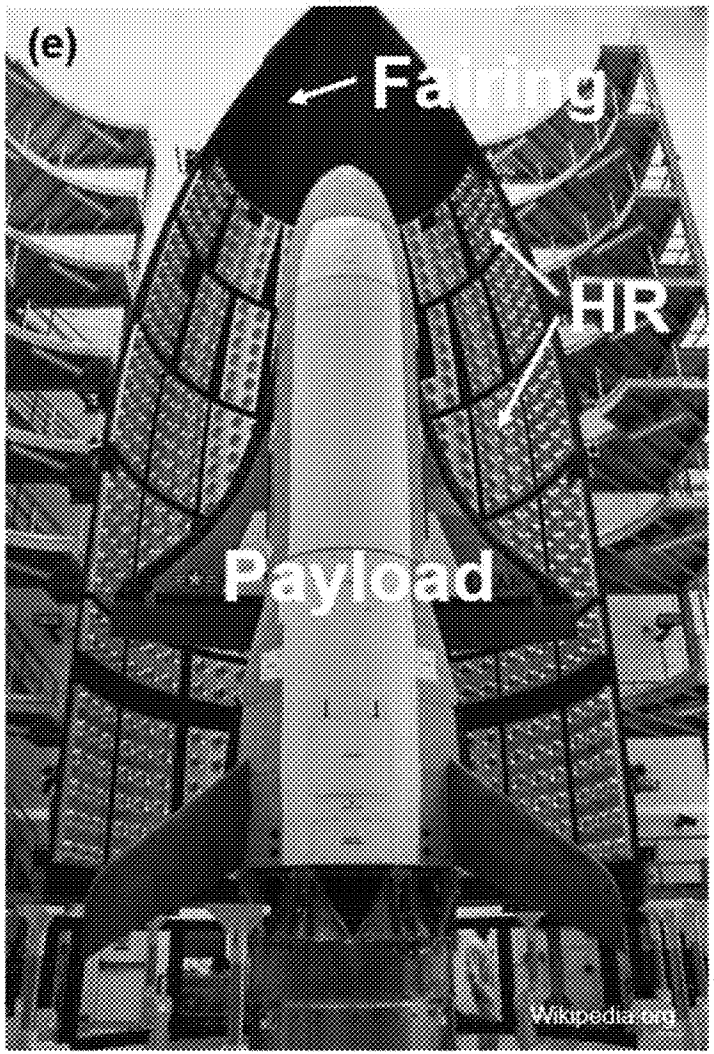
FIG. 1E illustrates a real-world application of a traditional HR with a wall-lining of a space launchers fairing.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended.

This disclosure relates to a Helmholtz resonator (HR) being able to provide broadband control of acoustic pressure waves for applications such as noise, vibration, and flow control. The concept of HR is combined with the concept of an Acoustic Black Hole (indicated as ABH-HR in the following description) in order to extend the operating bandwidth of the acoustic absorber and provide pressure attenuation over a broad range of frequencies. In aerospace applications, for example, when lined along the inner walls of a fairing system, a fuselage, or a jet engine, coupled ABH-HR technologies of the present application provide optimal acoustic wave attenuation at both high-power settings of takeoff as well as during cruise flight.

While traditional HRs are made of a rigid cavity and operate at a single frequency, various embodiments of the present application relates to HRs achieving broadband energy attenuation due to the tapered flexible element. The ABH-HR does not change the total volume of the cavity. This is unlike other HR designs that tried to achieve broadband performance by using a multi-chamber approach.

Figure 2A:
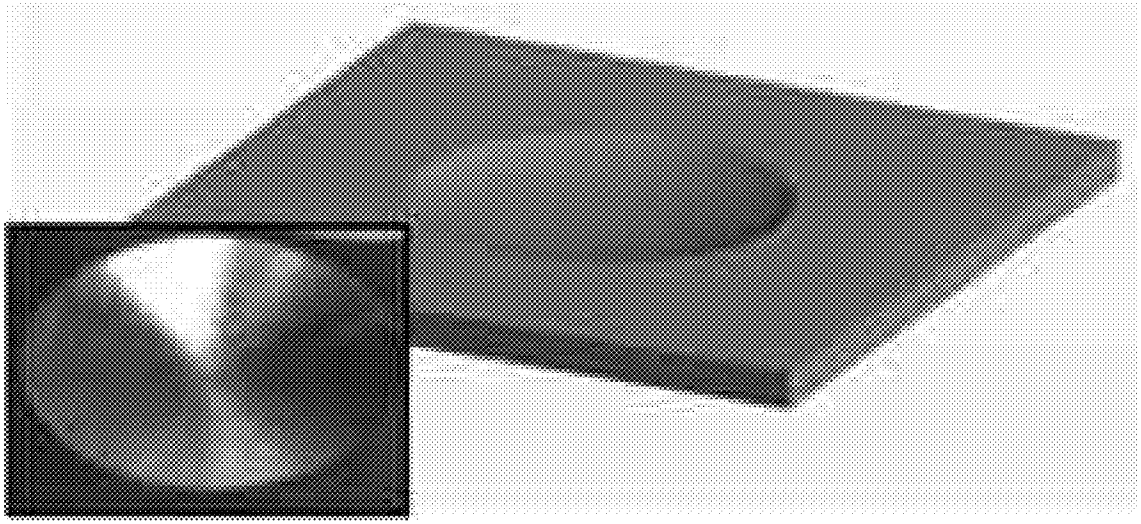
FIG. 2A illustrates a conceptual view of a plate structural element with an embedded Acoustic Black Hole which is a power-law taper typically obtained by machining an initially flat plate. The inset in FIG. 2A illustrates a practical realization of the ABH in an aluminum plate, obtained by CNC machining.
Figure 2B:
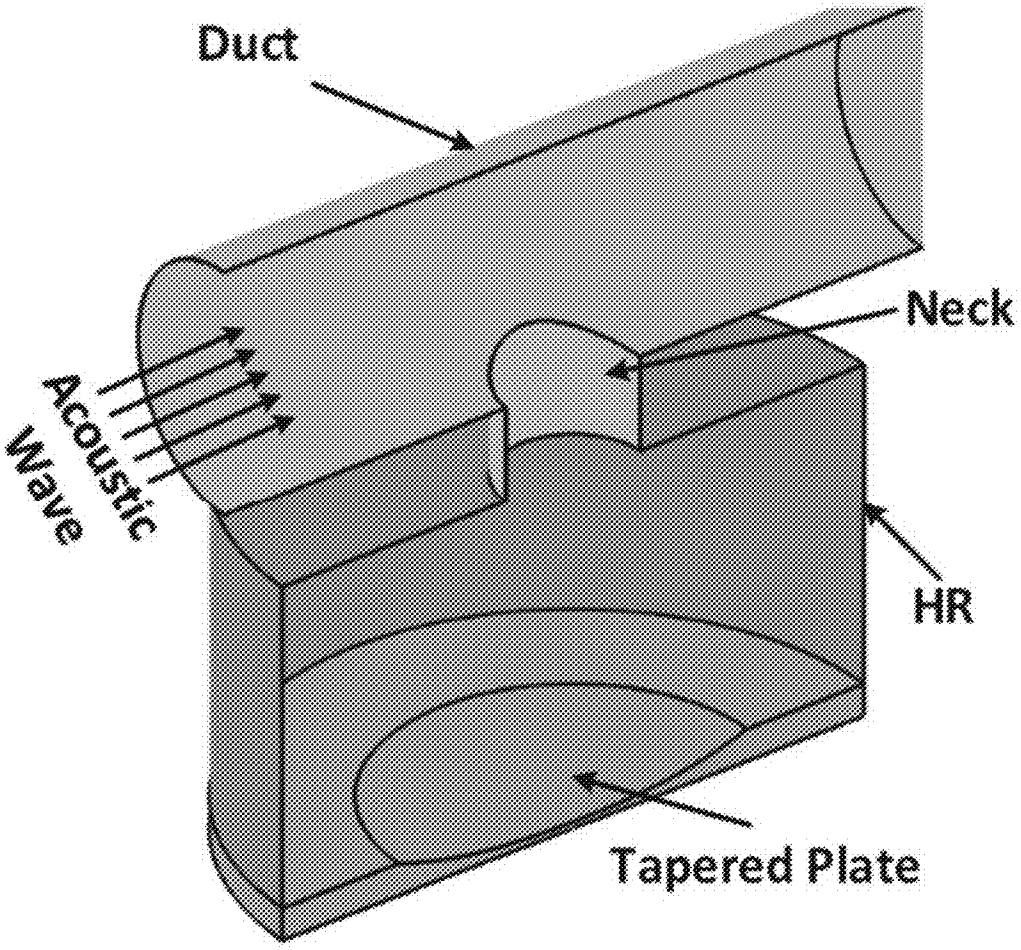
FIG. 2B illustrates a schematic view of an embodiment of this disclosure showing a HR with the embedded flexible ABH element.

Various components as they relate to various embodiments of the present application are reviewed in FIGS. 2A through 2B. In particular, FIG. 2A illustrates a conceptual view of a plate structural element with an embedded Acoustic Black Hole which is a power-law taper typically obtained by machining an initially flat plate. The inset in FIG. 2A illustrates a practical realization of the ABH in an aluminum plate, obtained by CNC machining. FIG. 2B illustrates a schematic view an embodiment of this disclosure showing a HR with the embedded flexible ABH element. Refereeing to FIG. 2B, the HR is connected to a duct in which the amplitude of a pressure wave is to be controlled.

Figure 2C:
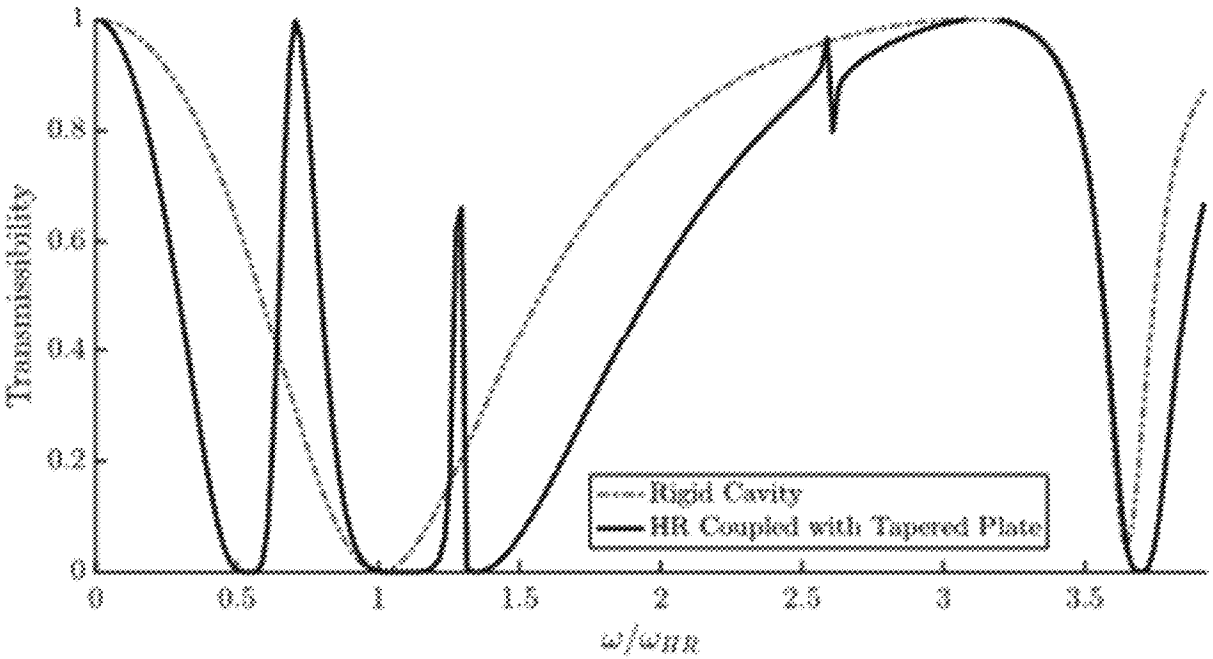
FIG. 2C illustrates numerical results from a fluid-structure model showing the performance of the proposed invention compared to a classical HR.

FIG. 2C illustrates numerical results of the transmission coefficient in the duct obtained via fully coupled fluid-structure interaction models. Results compare the transmission coefficient from a traditional HR (B) and from the ABH-HR (C) and indicate that this embodiment of the disclosure outperforms the traditional design, particularly in the high-frequency range (i.e. $\omega/\omega_{HR}>1$). Various embodiments of the present application relate to a multi-stage cavity that employs several membranes with different ABH tapers. These membranes can be made of polymers, metals, or plastic materials.

The performance of many practical applications are determined by the ability to control the evolution and the spectral characteristics of a pressure field in a fluid. Some relevant examples include:

1) Sound quality of concert halls and interior acoustics: Selected harmonic can be eliminated by ABH-HR, thereby avoiding annoying reverberating sound in the room.
2) Noise produced by exhaust systems for all forms of stationary and mobile internal combustion engines: Detrimental harmonics can be eliminated by ABH-HR to control noise output, thereby resulting in better protection of critical electronics and structures.
3) Acoustic pressure in space launch systems: The level of pressure at take-off inside the fairings of space launch systems can be severe to damage the payload. HR have been used traditionally to reduce sound pressure levels (SPL) in lunch systems. The ABH-HR design proposed according to various embodiments of this disclosure results in higher SPL reduction over a broad range of frequencies. This is in sharp contrast to traditional HR designs that are mostly effective at a single frequency (i.e. the resonance frequency of the HR).
4) Transportation system interior noise control: All transportation systems have need to control the acoustic pressure in the interior cabin (the so-called cabin noise) so as to improve the passenger comfort. In some cases, like in rotorcraft systems, noise largely impacts the performance and awareness of the pilot. ABH-HR can therefore be deployed to control interior noise in transportation systems.
5) External aerodynamics and flow control: The ABH-HR could be mounted on aircraft wings to provide purely-passive, high-frequency flow control, and reduce the transition from laminar to turbulent. Such capability can improve performance and handling of the next generation of hypersonic aircrafts.

Various embodiments of this disclosure describe an acoustic resonator containing a cavity in a rigid body, at least one flexible plate containing a tapered section located inside the cavity, and a hollow tube (neck) connecting the cavity to environment external to the rigid body. The rigid body can be made of metal or polymer or plastic. In some embodiments of the acoustic resonator of this disclosure, there can be multiple flexible tapered plates each containing a tapered section. The flexible plates can be made from any solid material, based on design requirements, they can be chosen from composites, polymers, or plastic materials. The flexible plates can also be made of a metal such as, but not limited to aluminum or copper or an alloy such as, but not limited to steel. In some embodiments of the acoustic resonator of the disclosure, the tapered section contains a hole. Further, in some embodiments, the multiple flexible tapered plates each containing a tapered section can be arranged such that the cavity in the rigid body is subdivided into sections with different volumes. It should be recognized that in some embodiments, these different volumes are equal. In some other embodiments these different volumes can be in the decreasing order or increasing order from the hollow tube end of the cavity. In some embodiments of the acoustic resonators of this disclosure, the different volumes are predetermined. It should be recognized that such predetermination of the volumes can be accomplished by utilizing a mathematical function based on geometrical and material properties to control the SPL absorption spectrum. Further, in some embodiments of the acoustic resonators of this disclosure, the cavity has a varying cross-sectional area. The variation of the cross-sectional area can be described by a mathematical function that links the area with the specific location within the cavity. Monotonic area variations (either increasing or decreasing) are preferable. Either linear or power-law type variations can be used. The varying area will increase the self-tuning capabilities of the cavity and help achieving desired broadband performance.

Various embodiments of the present application describe an acoustic resonator assembly comprising a plurality of acoustic resonators, each containing a cavity in a rigid body; at least one flexible plate containing a tapered section located inside the cavity; and a hollow tube connecting the cavity to environment external to the rigid body. In some embodiments of the acoustic resonator assembly of this disclosure, at least one flexible plate contains a hole in the tapered section of the plate, and a hollow tube passes through the hole connecting the regions on either side of the flexible plate. In some embodiments of the acoustic resonator assembly of this disclosure, there can be multiple flexible plates, each containing holes so aligned that a hollow tube going through the aligned holes connects two or more different volumes.

It should be recognized that by virtue of the constructional features of the acoustic resonators of this disclosure, the sound attenuation properties differ. Thus the acoustic resonators and acoustic resonator assemblies of this disclosure can function as metamaterials since their properties depend on the structural features of the acoustic resonators and assemblies.

Figure 3:
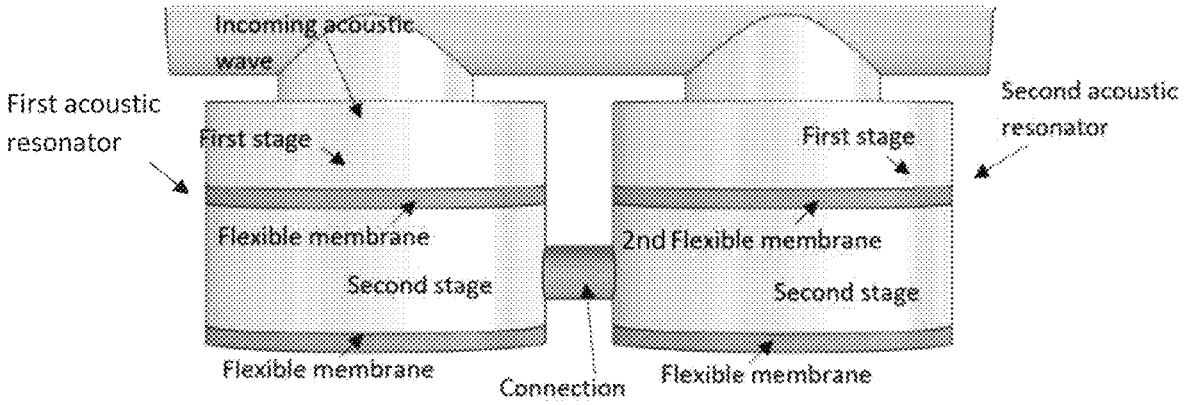
FIG. 3 illustrates a first resonator system in accordance with one or more embodiments.

FIG. 3 illustrates a first resonator system in accordance with one or more embodiments. The first resonator system includes two resonators coupled together. Each resonator has two stages which are separated by a flexible membrane. The two resonators are coupled together by a connection. The flexible membrane tapers in the center into a neck. The neck has a hole in the middle. The flexible membrane at the bottom of the second stages of both the resonators are neither tapered nor holed. In some embodiments, the flexible membrane at the bottom of the second stages of both the resonators are tapered without any holes. In some embodiments, the flexible membrane at the bottom of the second stages of both the resonators do not have any tapers nor any holes.

A method of using an acoustic resonator system above includes receiving at a first stage of a resonator an incoming acoustic wave. The method then continues with resonating the incoming wave with a flexible membrane, a taper of the flexible membrane, and a cavity of a first stage. This produces a synergistic effect on a resulting acoustic resonance. The method then continues with transforming an acoustic energy associated with the incoming acoustic wave into an elastic energy. The elastic energy is channeled through the flexible membrane, which reduces an intensity of the incoming acoustic wave and resulting in a first reduced incoming acoustic wave. Additionally, the method includes transferring the first reduced incoming acoustic wave through a hole of a neck of the flexible membrane. Moreover, the method includes transferring a first pressure wave caused by a perturbation in the flexible membrane into a second stage, thereby producing a second acoustic wave. In at least one embodiment, a second elastic wave is also produced if the second stage of the resonator has a flexible membrane.

The method further includes receiving at a second stage of a second acoustic resonator, through a connection, the first reduced incoming acoustic wave and the second acoustic wave. The connection is in fluid communication with the second stage of the acoustic resonator and the second stage of the second acoustic resonator. Furthermore, the method includes resonating the first reduced incoming acoustic wave and the second acoustic wave with a second flexible membrane of the second acoustic resonator, a second taper of the second acoustic resonator, and a second cavity of the second stage of the second acoustic resonator. Further, the method includes transforming a second acoustic energy associated with the first reduced incoming acoustic wave and the second acoustic wave into a second elastic energy. The second elastic energy is channeled through the second flexible membrane of the second acoustic resonator, thereby reducing a second intensity of the first reduced incoming acoustic wave and the second acoustic wave. This results in a further reduced incoming acoustic wave and a reduced second acoustic wave. Moreover, the method includes transferring the further reduced incoming acoustic wave and the reduced second acoustic wave through a hole of a neck of the second flexible membrane of the second acoustic resonator. Next, the method includes transferring a second pressure wave caused by a second perturbation in the second flexible membrane into a first stage of the second acoustic resonator. This produces a third acoustic wave, where an intensity of the third acoustic wave is less than an intensity of the incoming acoustic wave. The method also includes interfering the third acoustic wave with an ambient wave.

In at least one embodiment, the synergistic effect on the resulting acoustic resonance is produced by perturbing the flexible membrane with an acoustic energy of the incoming acoustic wave. The elastic energy is channeled through the taper of the flexible membrane. The taper of the flexible membrane comprises the neck with the hole.

Figure 4:
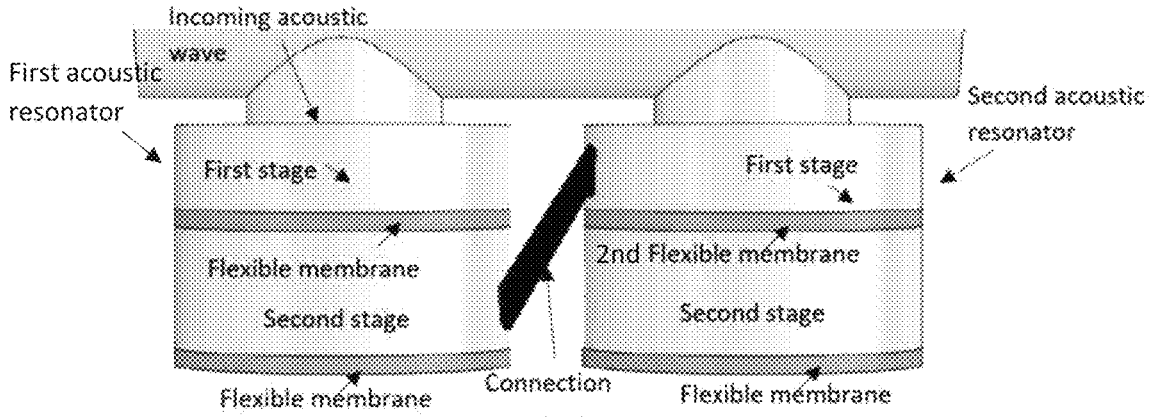
FIG. 4 illustrates a second resonator system in accordance with one or more embodiments.

FIG. 4 illustrates a second resonator system in accordance with one or more embodiments. The second resonator system includes two resonators coupled together. Each resonator has two stages which are separated by a flexible membrane. The two resonators are coupled together by a connection. A second stage of a first resonator connects a first stage of the second resonator through the connection. The flexible membrane tapers in the center into a neck. The neck has a hole in the middle. In some embodiments, the flexible membrane at the bottom of the second stages of both the resonators are tapered without any holes. In some embodiments, the flexible membrane at the bottom of the second stages of both the resonators do not have any tapers nor any holes.

A method of using an acoustic resonator system above includes receiving at a first stage of a resonator an incoming acoustic wave. The method further includes resonating the incoming wave with a flexible membrane, a taper of the flexible membrane, and a cavity of a first stage. This produces a synergistic effect on a resulting acoustic resonance. Additionally, the method includes transforming an acoustic energy associated with the incoming acoustic wave into an elastic energy. The elastic energy is channeled through the flexible membrane, thereby reducing an intensity of the incoming acoustic wave and resulting in a first reduced incoming acoustic wave. Additionally, the method includes transferring the first reduced incoming acoustic wave through a hole of a neck of the flexible membrane. Moreover, the method includes transferring a first pressure wave caused by a perturbation in the flexible membrane into a second stage, thereby producing a second acoustic wave. Further, the method includes receiving at a first stage of a second acoustic resonator, through a connection, the first reduced incoming acoustic wave and the second acoustic wave, where the connection is in fluid communication with the second stage of the acoustic resonator and the first stage of the second acoustic resonator.

The method proceeds with resonating the first reduced incoming acoustic wave and the second acoustic wave with a second flexible membrane of the second acoustic resonator, a second taper of the second acoustic resonator, and a second cavity of the second stage of the second acoustic resonator. Additionally, the method includes transforming a second acoustic energy associated with the first reduced incoming acoustic wave and the second acoustic wave into a second elastic energy. The second elastic energy is channeled through the second flexible membrane of the second acoustic resonator, thereby reducing a second intensity of the first reduced incoming acoustic wave and the second acoustic wave. This results in a further reduced incoming acoustic wave and a reduced second acoustic wave. Moreover, the method includes transferring the further reduced incoming acoustic wave and the reduced second acoustic wave through a hole of a neck of the second flexible membrane of the second acoustic resonator. Next, the method includes transferring a second pressure wave caused by a second perturbation in the second flexible membrane into a second stage of the second acoustic resonator. This produces a third acoustic wave where an intensity of the third acoustic wave is less than an intensity of the incoming acoustic wave. Additionally, the method includes interfering the first reduced incoming acoustic wave and the second acoustic wave with an ambient wave.

In at least one embodiment, the synergistic effect on the resulting acoustic resonance is produced by perturbing the flexible membrane with an acoustic energy of the incoming acoustic wave. The elastic energy is channeled through the taper of the flexible membrane. The taper of the flexible membrane comprises the neck with the hole.

Figure 5:
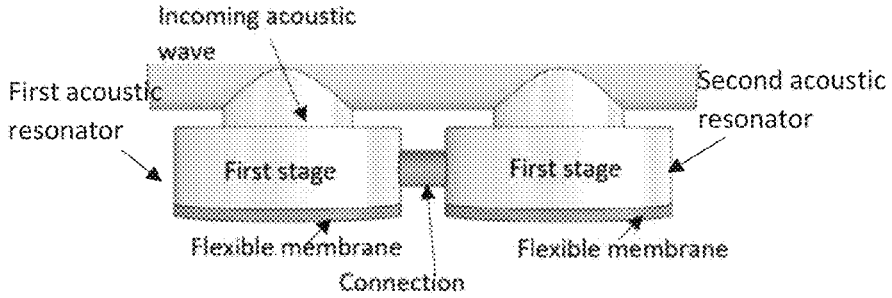
FIG. 5 illustrates a third resonator system in accordance with one or more embodiments.

FIG. 5 illustrates a third resonator system in accordance with one or more embodiments. The third resonator system includes two or more resonators coupled together. Each resonator has a single stage. The two resonators are coupled together by a connection. In at least one embodiment, a bottom of each stage of the two resonators includes a flexible membrane. In some embodiments, the flexible membrane tapers in the center into a neck. In some embodiments, the neck has a hole in the middle. In some embodiments, the flexible membrane at the bottom of the second stages of both the resonators are tapered without any holes. In some embodiments, the flexible membrane at the bottom of the second stages of both the resonators do not have any tapers nor any holes.

A method of using an acoustic resonator system above includes receiving at a first stage of a resonator an incoming acoustic wave. The method additionally includes resonating the incoming wave with a cavity of a first stage. This produces a synergistic effect on a resulting acoustic resonance. Moreover, the method includes transforming an acoustic energy associated with the incoming acoustic wave into an elastic energy, thereby reducing an intensity of the incoming acoustic wave and resulting in a first reduced incoming acoustic wave. Next, the method includes transferring the first reduced incoming acoustic wave through a connection, wherein the connection is in fluid communication with the first stage of the acoustic resonator and a first stage of a second acoustic resonator. The method also includes receiving at the first stage of the second acoustic resonator, through the connection, the first reduced incoming acoustic wave;

Additionally, the method includes resonating the first reduced incoming acoustic wave with a cavity of the first stage of the second acoustic resonator. Moreover, the method includes transforming a second acoustic energy associated with the first reduced incoming acoustic wave into a second elastic energy, thereby reducing a second intensity of the first reduced incoming acoustic wave. This results in a further reduced incoming acoustic wave. Additionally, the method includes interfering the further reduced incoming acoustic wave with an ambient wave. In at least one embodiment, producing synergistic effect on a resulting acoustic resonance includes perturbing walls of the first stage with an acoustic energy of the incoming acoustic wave.

The invention has been described in detail with particular reference to certain preferred aspects thereof, but it will be understood that variations, combinations, and modifications can be effected by a person of ordinary skill in the art within the spirit and scope of the invention. Other implementations may be possible.

The invention claimed is:

1. A method of using an acoustic resonator system comprising:

receiving at a first stage of a resonator an incoming acoustic wave;

resonating the incoming wave with a flexible membrane, a taper of the flexible membrane, and a cavity of a first stage, thereby producing synergistic effect on a resulting acoustic resonance;

transforming an acoustic energy associated with the incoming acoustic wave into an elastic energy, wherein the elastic energy is channeled through the flexible membrane, thereby reducing an intensity of the incoming acoustic wave and resulting in a first reduced incoming acoustic wave;

transferring the first reduced incoming acoustic wave through a hole of a neck of the flexible membrane; and transferring a first pressure wave caused by a perturbation in the flexible membrane into a second stage, thereby producing a second acoustic wave.

2. The method of claim 1, further comprising:

receiving at a second stage of a second acoustic resonator, through a connection, the first reduced incoming acoustic wave and the second acoustic wave, wherein the connection is in fluid communication with the second stage of the acoustic resonator and the second stage of the second acoustic resonator;

resonating the first reduced incoming acoustic wave and the second acoustic wave with a second flexible membrane of the second acoustic resonator, a second taper of the second acoustic resonator, and a second cavity of the second stage of the second acoustic resonator;

transforming a second acoustic energy associated with the first reduced incoming acoustic wave and the second acoustic wave into a second elastic energy, wherein the second elastic energy is channeled through the second flexible membrane of the second acoustic resonator, thereby reducing a second intensity of the first reduced incoming acoustic wave and the second acoustic wave, thereby resulting in a further reduced incoming acoustic wave and a reduced second acoustic wave;

transferring the further reduced incoming acoustic wave and the reduced second acoustic wave through a hole of a neck of the second flexible membrane of the second acoustic resonator; and transferring a second pressure wave caused by a second perturbation in the second flexible membrane into a first stage of the second acoustic resonator, thereby producing a third acoustic wave, wherein an intensity of the third acoustic wave is less than an intensity of the incoming acoustic wave.

3. The method of claim 1, further comprising:

interfering the third acoustic wave with an ambient wave.

4. The method of claim 1, wherein the resonating the incoming wave with the flexible membrane, the taper of the flexible membrane, and the cavity of the first stage, thereby producing synergistic effect on the resulting acoustic resonance comprises:

perturbing the flexible membrane with an acoustic energy of the incoming acoustic wave.

5. The method of claim 1, wherein the elastic energy is channeled through the taper of the flexible membrane.

6. The method of claim 1, wherein the taper of the flexible membrane comprises the neck with the hole.

7. A method of using an acoustic resonator system comprising:

receiving at a first stage of a resonator an incoming acoustic wave;

resonating the incoming wave with a flexible membrane, a taper of the flexible membrane, and a cavity of a first stage, thereby producing synergistic effect on a resulting acoustic resonance;

transforming an acoustic energy associated with the incoming acoustic wave into an elastic energy, wherein the elastic energy is channeled through the flexible membrane, thereby reducing an intensity of the incoming acoustic wave and resulting in a first reduced incoming acoustic wave;

transferring the first reduced incoming acoustic wave through a hole of a neck of the flexible membrane;

transferring a first pressure wave caused by a perturbation in the flexible membrane into a second stage, thereby producing a second acoustic wave; and receiving at a first stage of a second acoustic resonator, through a connection, the first reduced incoming acoustic wave and the second acoustic wave, wherein the connection is in fluid communication with the second stage of the acoustic resonator and the first stage of the second acoustic resonator.

8. The method of claim 7, further comprising:

resonating the first reduced incoming acoustic wave and the second acoustic wave with a second flexible membrane of the second acoustic resonator, a second taper of the second acoustic resonator, and a second cavity of the second stage of the second acoustic resonator;

transforming a second acoustic energy associated with the first reduced incoming acoustic wave and the second acoustic wave into a second elastic energy, wherein the second elastic energy is channeled through the second flexible membrane of the second acoustic resonator, thereby reducing a second intensity of the first reduced incoming acoustic wave and the second acoustic wave, thereby resulting in a further reduced incoming acoustic wave and a reduced second acoustic wave;

transferring the further reduced incoming acoustic wave and the reduced second acoustic wave through a hole of a neck of the second flexible membrane of the second acoustic resonator; and transferring a second pressure wave caused by a second perturbation in the second flexible membrane into a second stage of the second acoustic resonator, thereby producing a third acoustic wave, wherein an intensity of the third acoustic wave is less than an intensity of the incoming acoustic wave.

9. The method of claim 8, further comprising:

interfering the first reduced incoming acoustic wave and the second acoustic wave with an ambient wave.

10. The method of claim 9, wherein the resonating the incoming wave with the flexible membrane, the taper of the flexible membrane, and the cavity of the first stage, thereby producing synergistic effect on the resulting acoustic resonance comprises:

perturbing the flexible membrane with an acoustic energy of the incoming acoustic wave.

11. The method of claim 10, wherein the elastic energy is channeled through the taper of the flexible membrane.

12. The method of claim 11, wherein the taper of the flexible membrane comprises the neck with the hole.

13. A method of using an acoustic resonator system comprising:

receiving at a first stage of a resonator an incoming acoustic wave;

resonating the incoming wave with a cavity of a first stage, thereby producing synergistic effect on a resulting acoustic resonance;

transforming an acoustic energy associated with the incoming acoustic wave into an elastic energy, thereby reducing an intensity of the incoming acoustic wave and resulting in a first reduced incoming acoustic wave; and transferring the first reduced incoming acoustic wave through a connection, wherein the connection is in fluid communication with the first stage of the acoustic resonator and a first stage of a second acoustic resonator.

14. The method of claim 13, further comprising:

receiving at the first stage of the second acoustic resonator, through the connection, the first reduced incoming acoustic wave;

resonating the first reduced incoming acoustic wave with a cavity of the first stage of the second acoustic resonator;

transforming a second acoustic energy associated with the first reduced incoming acoustic wave into a second elastic energy, thereby reducing a second intensity of the first reduced incoming acoustic wave, thereby resulting in a further reduced incoming acoustic wave.

15. The method of claim 14, further comprising:

interfering the further reduced incoming acoustic wave with an ambient wave.

16. The method of claim 15, wherein the resonating the incoming wave with the cavity of the first stage, thereby producing synergistic effect on a resulting acoustic resonance comprises:

perturbing walls of the first stage with an acoustic energy of the incoming acoustic wave.

* * * * *